US006763214B2

(12) United States Patent
Sugihara

(10) Patent No.: US 6,763,214 B2
(45) Date of Patent: Jul. 13, 2004

(54) DEVELOPING DEVICE AND METHOD FOR PERFORMING EFFECTIVE CHARGING AND MIXING OF DEVELOPER AND IMAGE FORMING APPARATUS USING THE DEVELOPING DEVICE

(75) Inventor: Kazuyuki Sugihara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 116 days.

(21) Appl. No.: 10/212,714

(22) Filed: Aug. 7, 2002

(65) Prior Publication Data

US 2004/0028426 A1 Feb. 12, 2004

(30) Foreign Application Priority Data

Aug. 7, 2001 (JP) ..... 2001-239542

(51) Int. Cl.[7] ..... G03G 15/08
(52) U.S. Cl. ..... 399/254
(58) Field of Search ..... 399/254, 255, 399/256

(56) References Cited

U.S. PATENT DOCUMENTS

| | | | |
|---|---|---|---|
| 5,220,383 | A | 6/1993 | Enoki et al. |
| 5,227,842 | A | 7/1993 | Hayashi et al. |
| 5,239,344 | A | 8/1993 | Enoki et al. |
| 5,245,391 | A | 9/1993 | Suzuki et al. |
| 5,270,783 | A | 12/1993 | Bisaiji et al. |
| 5,311,263 | A | 5/1994 | Suzuki et al. |
| 5,384,628 | A | 1/1995 | Takami et al. |
| 5,389,733 | A | 2/1995 | Enoki et al. |
| 5,508,794 | A | 4/1996 | Ikesue et al. |
| 5,552,877 | A | 9/1996 | Ishikawa et al. |
| 5,617,198 | A | 4/1997 | Ishikawa et al. |
| 5,627,630 | A | 5/1997 | Matsumae et al. |
| 5,646,721 | A | 7/1997 | Sugihara et al. |
| 5,657,115 | A | 8/1997 | Sugihara |
| 5,671,470 | A | 9/1997 | Maruta et al. |
| 5,724,634 | A | 3/1998 | Maruta |
| 5,758,235 | A | 5/1998 | Kosuge et al. |
| 5,761,576 | A | 6/1998 | Sugihara et al. |

(List continued on next page.)

FOREIGN PATENT DOCUMENTS

| | | | | |
|---|---|---|---|---|
| JP | 55-053369 | * | 4/1980 | ..... G03G/15/08 |
| JP | 60-138577 | * | 7/1985 | ..... G03G/15/08 |
| JP | 02-018586 | * | 1/1990 | ..... G03G/15/08 |
| JP | 4-191876 | | 7/1992 | |
| JP | 06-348125 | * | 12/1994 | ..... G03G/15/08 |
| JP | 08-227217 | * | 9/1996 | ..... G03G/15/08 |
| JP | 09-073219 | | 3/1997 | |
| JP | 2000-019821 | | 1/2000 | |
| JP | 2001-154471 | | 6/2001 | |
| JP | 2001-255723 | | 9/2001 | |

*Primary Examiner*—Fred L. Braun
(74) *Attorney, Agent, or Firm*—Oblon, Spivak, McClelland, Maier & Neustadt, P.C

(57) ABSTRACT

A developing device and method that develops a latent image with a two-component developer includes a developer carrier, a first developer conveying screw that conveys the developer from a first to a second end of the first developer conveying screw and transfers the developer to the developer carrier, and a second developer conveying screw that conveys the developer from a first to a second end of the second developer conveying screw and conveys the developer from the second end of the second developer conveying screw to the first end of the first developer conveying screw. A following relationship is satisfied:

$$T2 \geqq 3T1,$$

where T1 is a time for conveying the developer from the first to the second end of the second developer conveying screw, and T2 is a time for conveying the developer from the first to the second end of the first developer conveying screw.

20 Claims, 8 Drawing Sheets

U.S. PATENT DOCUMENTS 5,765,059 A 6/1998 Kosuge et al.
5,768,664 A 6/1998 Kosuge et al.
5,787,328 A 7/1998 Sugihara et al.
5,819,145 A 10/1998 Tanaka et al.
5,826,146 A 10/1998 Maruta et al.
5,835,825 A 11/1998 Maruta
5,850,586 A 12/1998 Sugihara et al.
5,860,038 A 1/1999 Kato et al.
5,881,334 A 3/1999 Maruta et al.
5,887,224 A * 3/1999 Mizuishi et al. ..... 399/256
5,940,664 A 8/1999 Sugihara et al.
5,956,549 A 9/1999 Sugihara et al.
5,991,569 A 11/1999 Sugihara et al.
6,055,386 A 4/2000 Kato et al.
6,070,037 A 5/2000 Sugihara et al.
6,072,967 A 6/2000 Sugihara et al.
6,104,900 A 8/2000 Ishikawa et al.
6,122,469 A 9/2000 Miura et al.
6,141,520 A 10/2000 Kosuge
6,160,569 A 12/2000 Fujimori et al.
6,226,481 B1 5/2001 Yoneda et al.
6,259,876 B1 * 7/2001 Fukuda et al. ..... 399/254
6,324,369 B1 * 11/2001 Yamaguchi et al. ..... 399/254
6,336,020 B1 1/2002 Ishikawa et al.

* cited by examiner

DEVELOPING DEVICE AND METHOD FOR PERFORMING EFFECTIVE CHARGING AND MIXING OF DEVELOPER AND IMAGE FORMING APPARATUS USING THE DEVELOPING DEVICE

CROSS-REFERENCE TO RELATED APPLICATIONS

The present application claims priority to Japanese Patent Application No. 2001-239542 filed in the Japanese Patent Office on Aug. 7, 2001, the disclosure of which is incorporated by reference herein in its entirety.

BACKGROUND OF THE INVENTION

1. Field of the Invention

The present invention relates to a developing device that develops a latent image formed on a latent image carrier with a two-component developer, and more particularly, to an image forming apparatus such as a copying machine, a facsimile machine, a printer, or other similar image forming apparatus, including the developing device.

2. Discussion of the Background

In a developing device that develops a latent image formed on a latent image carrier with a two-component developer, a development mechanism typically includes a developer carrier (e.g., a development roller) and two developer conveying screws.

For example, Japanese Laid-open Patent Publication No. 4-191876 describes a developing device which includes a developer carrier that carries a developer while rotating, and two developer conveying screws arranged in parallel to each other and to a rotation center axis of the developer carrier at one side of the developer carrier in a direction orthogonal to the rotation center axis of the developer carrier. One of the two developer conveying screws is placed close to the developer carrier, and the other of the two is placed farther from the developer carrier. In this type of the developing device, a developer is circulated using the two developer conveying screws.

The two developer conveying screws perform mixture and conveyance of the developer in a superior manner in a horizontal direction (i.e., a longitudinal direction of the developer conveying screw). However, the mixture and conveyance of the developer in a direction orthogonal to the longitudinal direction of the developer conveying screw are not performed in a manner as well as that performed in the horizontal direction.

Accordingly, when a great amount of toner is supplied to a development mechanism, one of the two developer conveying screws placed closer to the developer carrier typically tends to cause a dirty background image due to insufficient charging of the toner supplied to the development mechanism and an uneven density in a form of a screw pitch (e.g., the formation of stripes of toner corresponding to threads of the screw).

Particularly, in a color image forming apparatus using the above-described developing device, the uneven density appears as an unevenness of color, thereby deteriorating image quality.

SUMMARY OF THE INVENTION

According to an aspect of the present invention, a developing device that develops a latent image carried on a latent image carrier with a two-component developer includes a developer carrier configured to carry a two-component developer while rotating, and a first developer conveying screw configured to convey the developer from a first end of the first developer conveying screw to a second end of the first developer conveying screw and to transfer the developer to the developer carrier. The first developer conveying screw is arranged about parallel to a rotation center axis of the developer carrier. The developing device further includes a second developer conveying screw configured to convey the developer from a first end of the second developer conveying screw to a second end of the second developer conveying screw and to convey the developer from the second end of the second developer conveying screw to the first end of the first developer conveying screw. The second developer conveying screw is arranged about parallel to the first developer conveying screw. A following relationship is satisfied:

$$T2 \geqq 3T1,$$

where T1 is a time for conveying the developer from the first to the second end of the second developer conveying screw, and T2 is a time for conveying the developer from the first to the second end of the first developer conveying screw.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
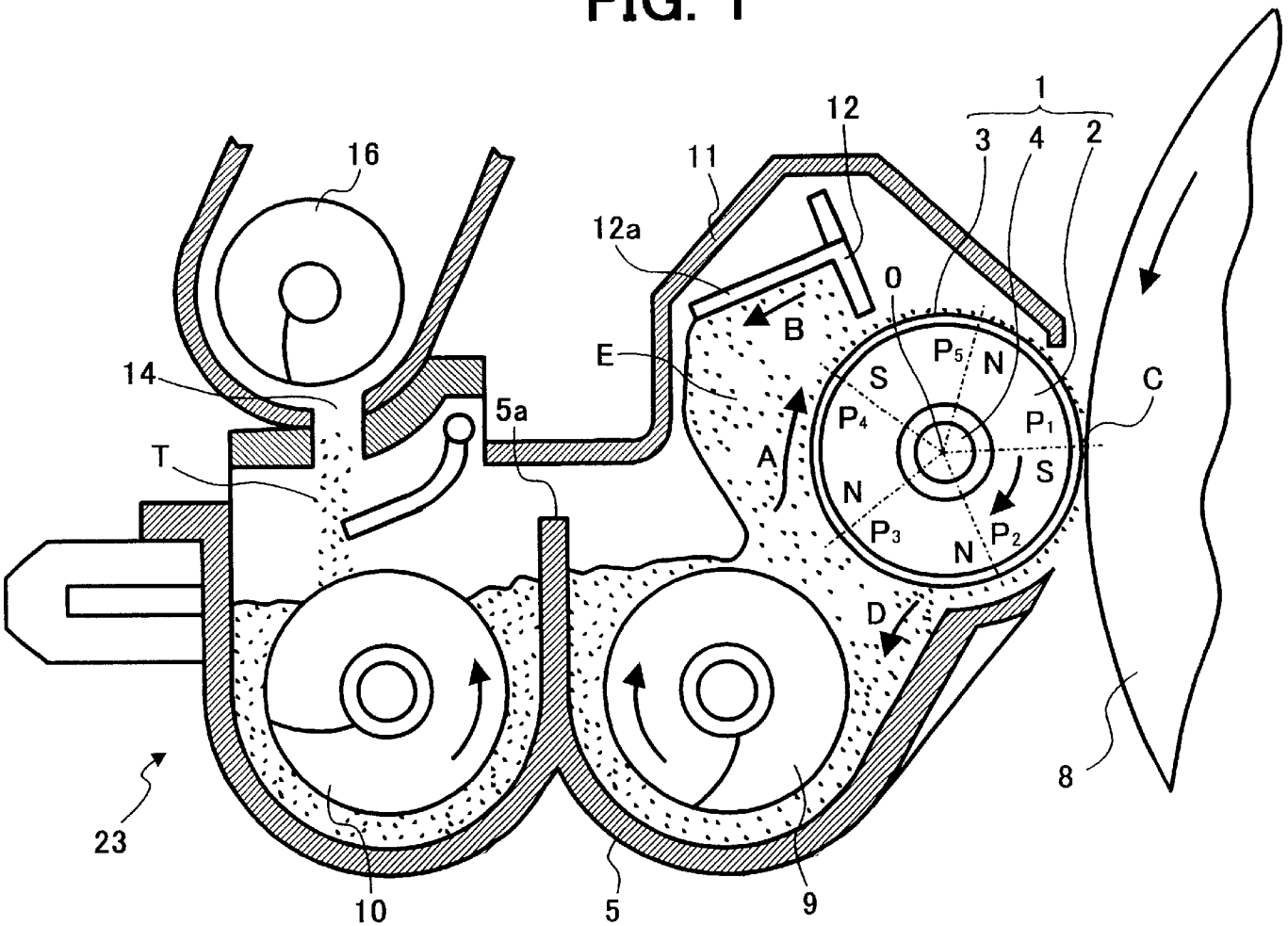
FIG. 1 is a schematic cross-sectional side view of a developing device according to an embodiment of the present invention.

Preferred embodiments of the present invention are described in detail with reference to the drawings, wherein like reference numerals designate identical or corresponding parts throughout the several views.

Figure 2:
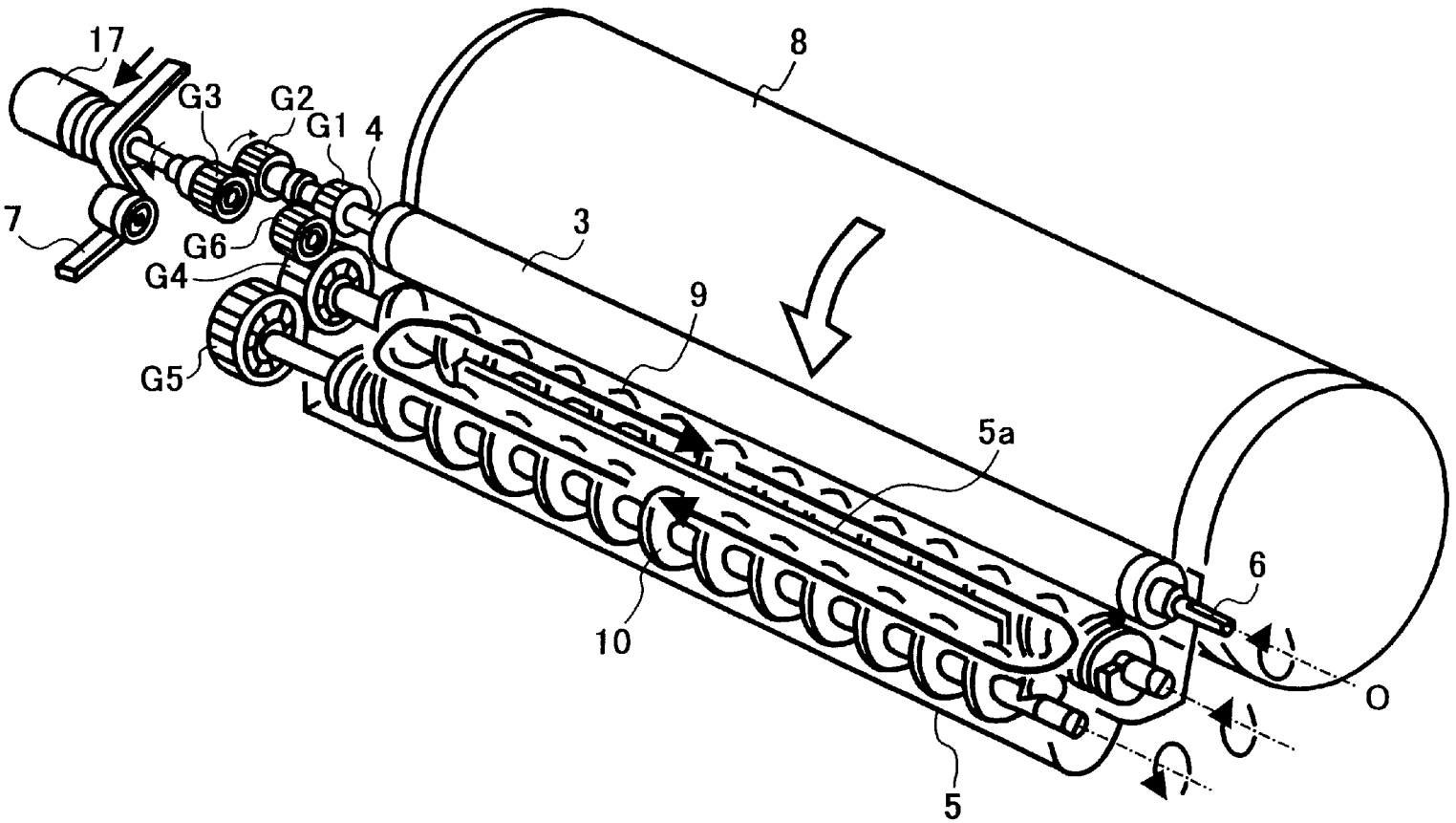
FIG. 2 is a schematic perspective view of the developing device according to the embodiment of FIG. 1.

FIG. 1 is a schematic cross-sectional side view of a developing device according to the embodiment of the present invention. FIG. 2 is a schematic perspective view of the developing device according to the embodiment of FIG.

1. Referring to FIGS. 1 and 2, a developing device 23 includes a developer carrier 1, two developer conveying screws 9 and 10, a developer regulating member 12, an attachment member 12*a* attached to the developer regulating member 12, a development case 5, and a development cover 11.

The developer carrier 1 constructed as a rotation body, such as a development roller, includes a magnet roller 2, a development sleeve 3, a rotation shaft 4, and a fixed shaft 6. The magnet roller 2 is formed from a cylindrical magnet fixed onto a stationary member. The development sleeve 3 is rotatably engaged with an outer peripheral portion of the magnet roller 2. The rotation shaft 4 is integrally formed with the development sleeve 3 at one end side of the development sleeve 3 in a longitudinal direction thereof, and unitarily rotates with the development sleeve 3. The fixed shaft 6 is integrally formed with the magnet roller 2 at the other end side of the development sleeve 3 in the longitudinal direction thereof and is fixed onto the development case 5. A developer including toner and magnetic carrier is conveyed while being agitated by the rotation of the development sleeve 3.

The rotation shaft 4 and the fixed shaft 6 are coaxially provided. The rotation shaft 4 penetrates the development case 5, and a portion of the rotation shaft 4 penetrating the development case 5 is rotatably supported. Further, gears G1 and G2 are fixed onto a portion of the rotation shaft 4 protruding outward from the development case 5. A gear G3 meshes with the gear G2. The gear G3 is driven to rotate by a driving force transmitted from a belt 7, which constructs a drive system, via a clutch 17, thereby causing the development sleeve 3 to rotate.

When a rotation center axis of the development sleeve 3 is indicated by a reference character O, the rotation center axis O equals a rotation center axis of the rotation shaft 4. At one side of the developer carrier 1 in a direction perpendicular to the rotation center axis O, a drum-shaped latent image carrier 8 constructed as a rotation body is arranged opposite to the development sleeve 3.

At the other side of the developer carrier 1 in a direction perpendicular to the rotation center axis O, i.e., at an opposite side of the latent image carrier 8, the two developer conveying screws 9 and 10 are arranged in parallel to the rotation center axis O.

The two developer conveying screws 9 and 10 are arranged in parallel to each other. The developer conveying screw 9 is placed close to the developer carrier 1, and the developer conveying screw 10 is placed farther from the developer carrier 1.

The respective both end shaft portions of the developer conveying screws 9 and 10 in the longitudinal direction thereof are rotatably supported by the development case 5. The respective one end shaft portions of the developer conveying screws 9 and 10 at the side of the gear G1 penetrate the side part of the development case 5. A gear G4 is fixed onto the one end shaft portion of the developer conveying screw 9, and a gear G5 is fixed onto the one end shaft portion of the developer conveying screw 10.

The gear G4 is positioned opposite to the gear G1. A gear G6 meshes with the both gears G1 and G4, and thereby a driving force transmitted from the gear G2 is further transmitted to the gears G1 and G4.

The first developer conveying screw 9 is placed side by side with the second developer conveying screw 10 at a position obliquely downward from the developer carrier 1. A partition plate 5*a*, which is integrally formed with the development case 5, is provided between the first and second developer conveying screws 9 and 10, and both ends of the partition plate 5*a* are provided with ports through which the developer is conveyed between the first and second developer conveying screws 9 and 10.

The latent image carrier 8 is constructed with a photoconductive drum, and is rotated in a direction indicated by the arrow on the latent image carrier 8 (i.e., in a counterclockwise direction). The first and second developer conveying screws 9 and 10 are rotated in directions indicated by the arrows on the first and second developer conveying screws 9 and 10, respectively.

Figure 3:
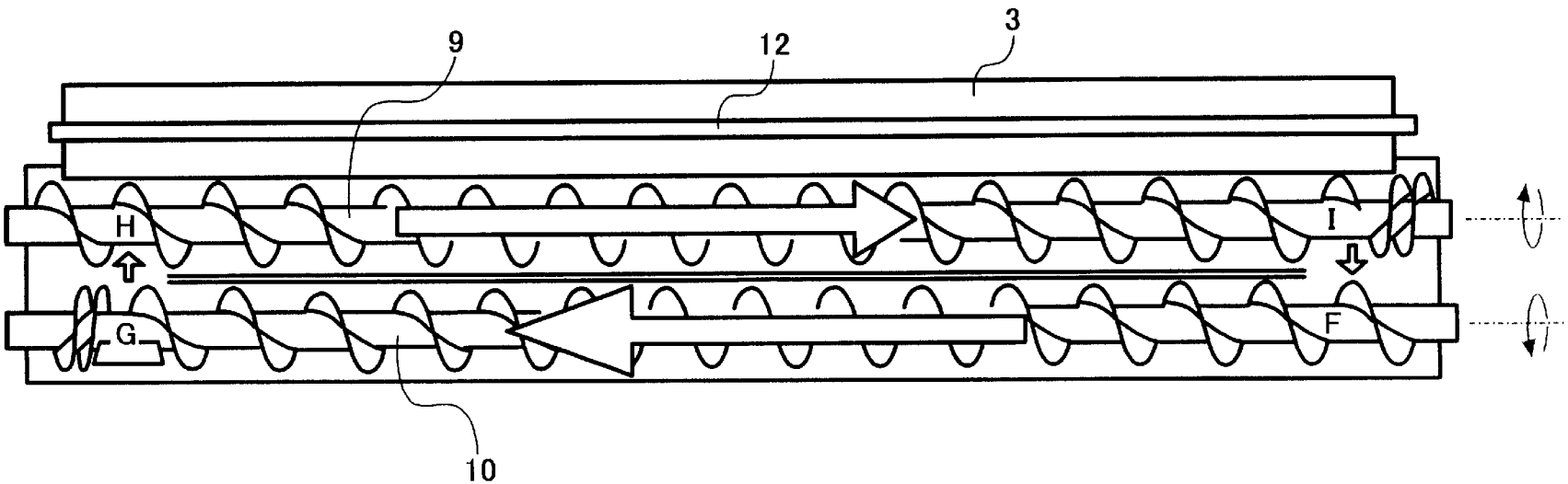
FIG. 3 is a top plan view of the developing device according to the embodiment of FIG. 1.

By rotating the two developer conveying screws 9 and 10, a developer including a mixture of toner and carrier is conveyed in circulation in a developer conveying path in a shape of narrow loop formed by the two developer conveying screws 9 and 10. Referring to FIGS. 2 and 3, the developer conveying path is shown by outlined arrows on the first and second developer conveying screws 9 and 10. In FIG. 3, the developer conveying path is indicated by outline arrows and forms a loop connecting end portions of the first and second developer conveying screws 9 and 10 indicated by reference characters F, G, H, and I.

While the developer is conveyed in circulation in the developer conveying path, the developer is sufficiently charged by the agitation of toner and carrier to visualize latent images formed on the latent image carrier 8. The developer is supplied to the development sleeve 3 and forms a magnet brush on the development sleeve 3. The magnet brush develops a latent image formed on the latent image carrier 8, thereby forming a visual (toner) image.

The residual toner is circulated again in the developer conveying path. A toner density detecting device (not shown) is provided in a developer circulation path in the developing device 23 so as to detect the density of toner of developer conveyed in circulation. When the density of toner detected by the toner density detecting device is lower than a predetermined value, fresh toner is supplied into the developer conveying path.

The position where fresh toner is supplied into the developer conveying path is located on the second developer conveying screw 10 and at an upstream side part of the second developer conveying screw 10 in the developer conveying direction, for example, at a position indicated by the reference character F in FIG. 3 (hereafter referred to as "position F"). The portion of the second developer conveying screw 10 corresponding to the position F has a cross section as illustrated in FIG. 1. An opening 14 is formed at a portion of the development cover 11 corresponding to the position F. A toner supplying screw 16 is provided above the opening 14. Fresh toner T falls through the opening 14 and is supplied onto the second developer conveying screw 10 by the rotation of the toner supplying screw 16.

A description will be further made of a exemplary construction of the developing device 23.

Referring to FIG. 1, five magnetic poles P1, P2, P3, P4, P5 of the magnets of the magnet roller 2 are radially arranged about the rotation center axis O. When the magnet roller 2 is seen from the rotation axial direction, the magnetic pole P1 is located at about or adjacent to a three o'clock position and opposite to the latent image carrier 8. The magnetic pole P2 is located at about or adjacent to a range of between about four to about five o'clock positions and opposite to the development case 5. The magnetic pole P3 is located at about or adjacent to a range of between about seven to about eight o'clock positions and opposite to the first developer conveying screw 9. The magnetic pole P4 is located at about or adjacent to a range of between about ten to about eleven o'clock positions. At the position opposing the magnetic pole P4, a developer holding section E is formed by the developer regulating member 12 and the attachment member 12*a*. The magnetic pole P5 is located at about or adjacent to a twelve o'clock position, under the development cover 11 of the developing device 23. The development sleeve 3 is rotated in a direction indicated by the arrow on the developer carrier 1 and passes the magnetic poles in an order of the magnetic poles P1, P2, P3, P4, and P5.

The magnetic pole P1, which is arranged at a development position indicated by a reference character C in FIG. 1 (hereafter referred to as "development position C"), is a south pole and serves as a development pole that forms a magnet brush at the development position C to develop a latent image on the latent image carrier 8 with developer. The magnetic poles P2 and P3 are north poles, and the developer is released from the developer carrier 1 at an area between the magnetic poles P2 and P3 but is again attracted to the developer carrier 1 by the magnetic pole P3. The magnetic pole P4 is a south pole. The developer regulating member 12 is provided above the magnetic pole P4 to regulate a thickness of a developer layer on the development sleeve 3. The attachment member 12*a* attached to the developer regulating member 12 covers an upstream side of the magnetic pole P4 in the rotating direction of the development sleeve 3. With provision of the developer regulating member 12 and the attachment member 12*a*, the developer holding section E is formed in a vicinity of the magnetic pole P4. In the developer holding section E, the toner and carrier of the developer are urged to receive charges by the action of friction so that the developer rises on the surface of the development sleeve 3 when it is attracted thereto.

As illustrated in FIG. 3, the circulation of the developer is performed by the first and second developer conveying screws 9 and 10 which are rotated in directions different from each other. Referring to FIG. 1, the developer conveyed by the developer conveying screws 9 and 10 is raised in the direction indicated by the arrow A in FIG. 1 by the magnetic force of the magnet roller 2 at a developer raising section corresponding to a part between the magnet poles P3 and P4. The developer on the development sleeve 3 is regulated by the developer regulating member 12 so that an amount of the developer necessary for the development process is passed through a gap formed between the developer regulating member 12 and the surface of the development sleeve 3. An excess amount of the developer rejected by the developer regulating member 12 is returned in a direction indicated by the arrow B in FIG. 1 along the attachment member 12*a*.

The developer passing through the gap formed between the developer regulating member 12 and the surface of the development sleeve 3 is used to develop a latent image on the latent image carrier 8 with developer at the development position C, so that the toner included in the developer is consumed. The developer from which the toner is consumed is removed from the development sleeve 3 in a direction indicated by an arrow D in FIG. 1 along the development case 5 facing the first developer conveying screw 9 inclined downwardly. Specifically, the above-described developer from which the toner is consumed is removed from the development sleeve 3 in a region between the magnet poles P2 and P3 by forces of magnetic repulsion and gravity. Such a developer removed from the development sleeve 3 is returned into the development case 5 and is again mixed by the first developer conveying screw 9 with the fresh developer which has not yet been used.

If the amount of the developer held in the developer holding section E surrounded by the developer regulating member 12 and the attachment member 12*a* is small, the conveyance efficiency of the developer in the longitudinal direction of the development sleeve 3 increases. However, the toner charging effect by the friction of the developer decreases, so that a dirty background image can occur. Further, when fresh toner is replenished to the inside of the development case 5, an uneven density in the longitudinal direction of the development sleeve 3 can be caused.

In order to prevent the above-described phenomena, a sufficient amount of developer can be held at the developer holding section E. Specifically, the sufficient amount of developer is held at the developer holding section E by controlling an opposing position of the developer regulating member 12 relative to the magnetic pole of the magnet roller 2, and by controlling a magnetic flux density at the opposing position. For example, the opposing position of the developer regulating member 12 is set in a vicinity of a position where a value of a magnetic flux density in a direction normal to the surface of the development sleeve 3 is maximum. The maximum value of the magnetic flux density is preferably set to in a range of about 400 to about 700 Gauss.

By setting the above-described opposing position of the developer regulating member 12 in a vicinity of a position where a value of a magnetic flux density in a direction normal to the surface of the development sleeve 3 is maximum, the following relationship is satisfied:

$$T2 \geqq 3T1,$$

where T1 is a time for conveying the developer from the one end (the position F in FIG. 3) to the other end (the position G in FIG. 3) of the second developer conveying screw 10, and T2 is a time for conveying the developer from the one end (the position H in FIG. 3) to the other end (the position I in FIG. 3) of the first developer conveying screw 9.

As described above, the sufficient amount of developer can be held at the developer holding section E by the magnetic force of the magnet roller 2 and the developer regulating member 12 and the attachment member 12*a*. If the above-described opposing position of the developer regulating member 12 is set in a vicinity of a position where a value of a magnetic flux density in a direction normal to the surface of the development sleeve 3 is small, the developer tends to flow without being held at the developer holding section E.

Further, with the above-described construction, the developer conveyed by the first developer conveying screw 9 is raised in the direction A in FIG. 1 by the magnetic force of the magnet roller 2, and is then circulated in the direction B in FIG. 1 along the attachment member 12*a* and returned to the first developer conveying screw 9. This circulation of the developer in the developer holding section E is repeated while the developer is conveyed from the one end (the position H in FIG. 3) to the other end (the position I in FIG. 3) of the first developer conveying screw 9. During the circulation of the developer which moves from the one end to the other end of the first developer conveying screw 9 taking three times or more as long as the developer which moves from the one end to the other end of the second developer conveying screw 10, the developer is sufficiently mixed and charged by the action of friction, so that the developer rises on the development sleeve 3 when it is attracted to the magnet roller 2. As a result, an image quality is enhanced without causing inferior images, such as a dirty background image and an image having an uneven density.

If a relatively great amount of toner is used at the development position C by, for example, a solid-colored image, the developer mainly including the carrier is returned to the fresh developer and is mixed with it. If mixing is not made in a sufficient manner, the concentration of toner in the developer can be uneven. If such developer is conveyed by the first developer conveying screw 9 and is raised in the direction A, the development process performed at the development position C can use an unevenly mixed developer. This can result in an uneven density in an image, typically in a direction relative to a spiral pitch of the first developer conveying screw 9.

To avoid this phenomenon, the mixture of the developer around the developer carrier 1 is improved. Specifically, the first and second developer conveying screws 9 and 10 are improved in the mixing performance, particularly, in a transverse (vertical) direction (i.e., a direction perpendicular to the rotation center axis O of the rotation shaft 4 in FIG. 2) relative to a horizontal direction (i.e., a direction of the rotation center axis O of the rotation shaft 4 in FIG. 2) in which the developer is conveyed. Such a mixing is referred to as a "vertical mixing". In contrast to the vertical mixing, the mixing in the direction in which the developer is conveyed is referred to as a "horizontal mixing".

Each of the first and second developer conveying screws 9 and 10 can have superior horizontal mixing capabilities but inferior vertical mixing capabilities, and therefore can be improved in its vertical mixing ability. For example, the spiral pitch of the developer conveying screw may be made greater and an angle of the spiral relative to a plane including the shaft of the screw is made smaller. Thereby, the mixing force in the vertical direction is increased, relative to the mixing force in the developer conveying (horizontal) direction. However, if the spiral pitch of the developer conveying screw is made greater, it can cause an extreme reduction of the horizontal mixing. As a result, an image can have an uneven density in the length direction of the developer carrier 1.

Figure 4:
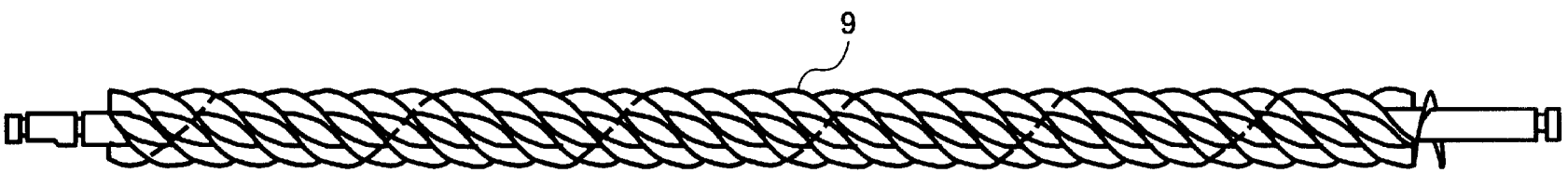
FIG. 4 is a schematic side view of a first developer conveying screw in the developing device of FIG. 1.

In order to satisfy the contradictory requirements, as illustrated in FIG. 4, the first developer conveying screw 9 is configured to have a plurality of spirals, such as five spirals, for example. With this configuration, the amount of horizontal mixing decreased or weakened by having the greater spiral pitch is improved. In addition, each spiral is made to have a smaller angle relative to the plane including the screw shaft so that the vertical mixing can be also increased or strengthened relative to horizontal mixing in the direction in which the developer is conveyed. Such a configuration of the first developer conveying screw 9 can obviate the above-described phenomenon of an uneven density in an image, in a direction relative to the spiral pitch of the first developer conveying screw 9.

The first developer conveying screw 9 thus configured to have the five spirals produces the above-described effects. However, if the second developer conveying screw 10 is configured to have a plurality of spirals, it can be difficult to balance the developer in the longitudinal direction of the screw (i.e., a rotation center axis direction). This may cause an uneven density or overflow of the developer from the development case 5, for example. This is due to interference caused at an area where the developer is transferred between the first and second developer conveying screws 9 and 10.

Specifically, the transfer of the developer between the first and second developer conveying screws 9 and 10 is performed at respective both end portions G/H, I/F in FIG. 3 of the first and second developer conveying screws 9 and 10 in the axial direction of the screw shafts. If each of the screws 9 and 10 has a plurality of spirals, the horizontal mixing is strengthened and therefore the developer elements are pushed against each other at the above both end portions G/H, I/F where the transfer occurs. As a result, the transfer is not optimally or smoothly performed.

Figure 5:
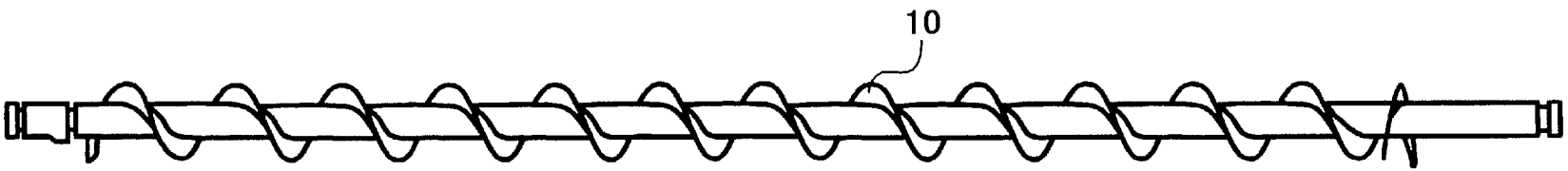
FIG. 5 is a schematic side view of a second developer conveying screw in the developing device of FIG. 1.

Therefore, the second developer conveying screw 10 is provided with a single spiral in the embodiment illustrated in FIG. 5. Such a single spiral configuration achieves a sufficient conveyance of the developer from the second developer conveying screw 10 to the first developer conveying screw 9 at the leading end portion G of the second developer conveying screw 10 and a sufficient receipt of the developer at the trailing end portion F of the second developer conveying screw 10. Thereby, the developing device 23 can effectively perform the circulation of the developer while improving the vertical mixing at the side of the developer carrier 1.

In order to achieve the above-described effects, the first and second developer conveying screws 9 and 10 can have the same spiral diameter and the same shaft diameter. In addition, the screws 9 and 10 can be driven to rotate at substantially the same speed.

As an example of the configuration of the first and second developer conveying screws 9 and 10 which allows to balance the developer in the longitudinal direction of the screw (i.e., a rotation center axis direction), the first developer conveying screw 9 may have two spirals each having a spiral pitch of 40 mm, and the second developer conveying screw 10 may have a single spiral having a spiral pitch of 25 mm.

As describe above, the position where fresh toner is supplied into the developer conveying path is located on the second developer conveying screw 10 and at an upstream side part of the second developer conveying screw 10 in the developer conveying direction (i.e., the position F in FIG. 3).

By supplying fresh toner into an upstream side part of the second developer conveying screw 10 in the developer conveying direction, a distance and time for making the fresh toner reach the development position C are each increased, thereby allowing the fresh toner to be sufficiently mixed with the developer. As a result, mixing of the developer at the side of the developer carrier 1 is improved, so that an uneven density in an image is prevented.

As described above, the magnet roller 2 in the developer carrier 1 includes the magnets having five magnetic poles P1–P5. The developer is conveyed in circulation between the developer carrier 1 and the first and second developer conveying screws 9 and 10.

With the configuration of the developer carrier 1 including the magnets having five magnetic poles P1–P5, the positions such as developer raising and removing positions to and from the development sleeve 3, a developer regulating position, and a development position can be arranged around the developer carrier 1 in a well-structured manner. As a result, the developing device 23 can be constructed in a compact size. For example, the size of the magnet roller 2 may be reduced by using a roller having an outer diameter of 18 mm or less.

The above-described developing device can be applied to both single-color image forming apparatus and multi-color image forming apparatus. First, a description will be made of a multicolor image forming apparatus to which the developing device is applied.

The above-described developing device 23 may be used not only as a single device but also as a so-called revolver type developing device.

Figure 6:
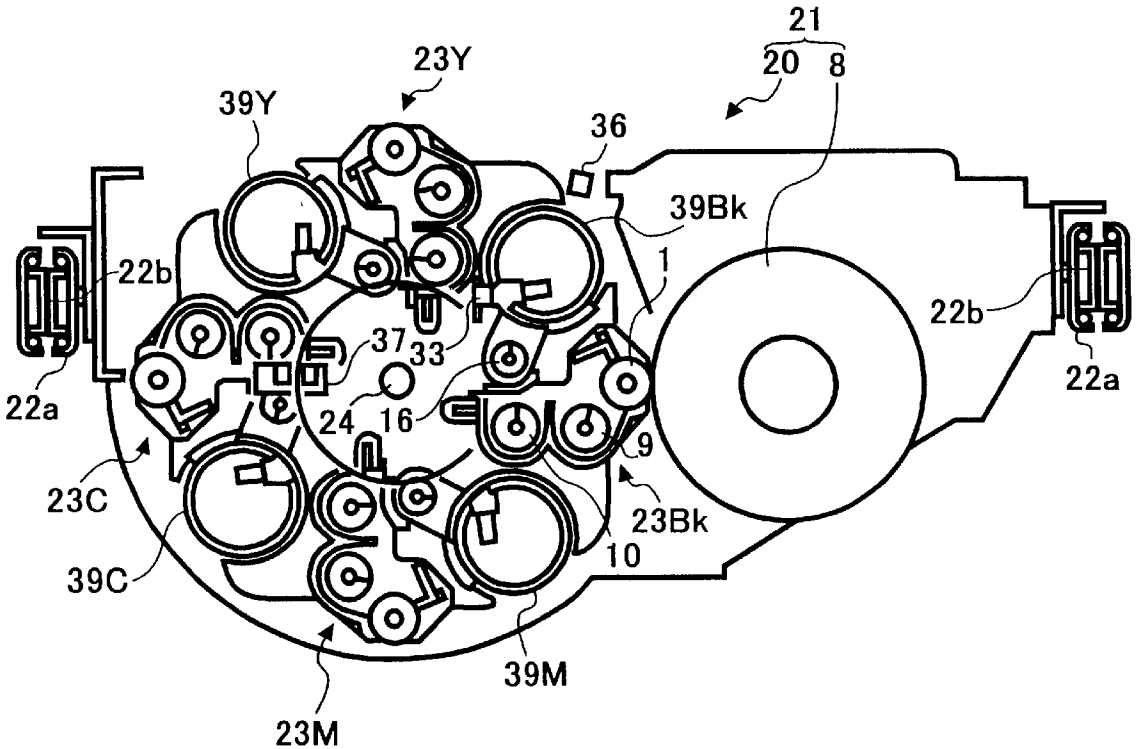
FIG. 6 is a schematic cross-sectional side view of a multi-color development section including a plurality of developing devices according to another embodiment of the present invention.
Figure 7:
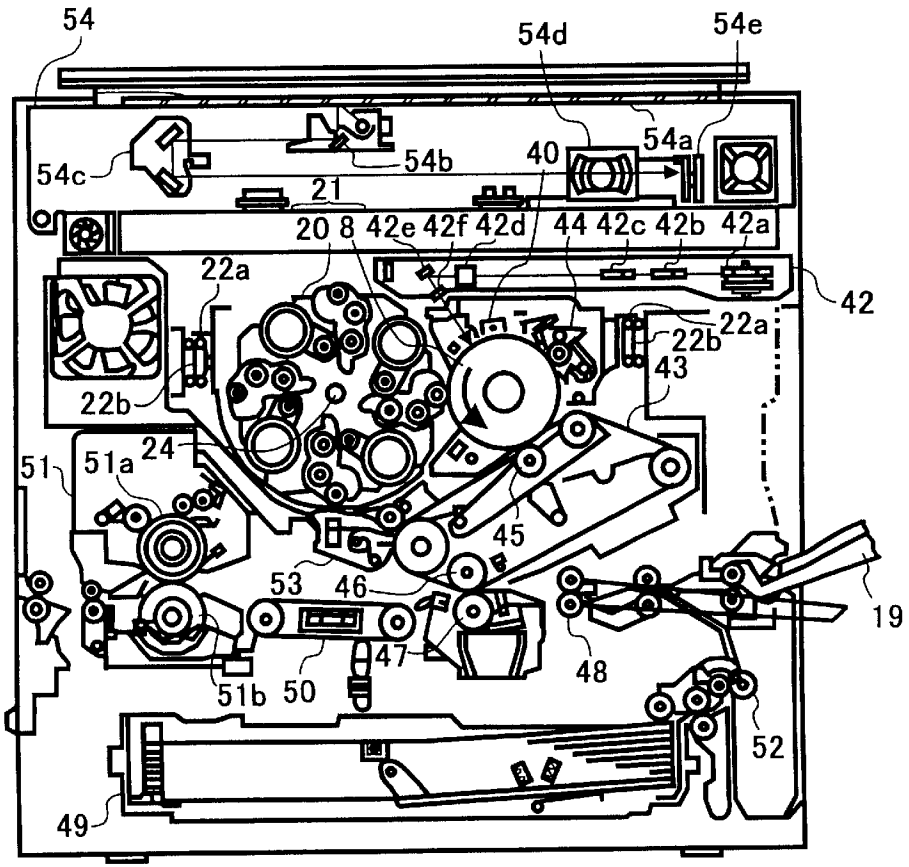
FIG. 7 is a schematic cross-sectional side view of a multi-color image forming apparatus in which the multi-color development section of FIG. 6 is attached to a main body of the multi-color image forming apparatus.

Referring to FIG. 7, an exemplary multi-color image forming apparatus includes a revolving development station 20. The revolving development station 20, the latent image carrier 8, and other elements are integrally accommodated in a multi-color development section 21. The multi-color development section 21 is detachably attached to a main body of the multi-color image forming apparatus. FIG. 6 is a schematic cross-sectional side view of the multi-color development section 21 detached from the main body of the multi-color image forming apparatus.

At both sides of the multi-color development section 21, slide rails 22*a* are provided. Further, in the main body of the multi-color image forming apparatus, slide guides 22*b* are provided to be paired with the slide rails 22*a*. The multi-color development section 21 is attached and detached by sliding the slide rails 22*a* on the slide guides 22*b*.

Next, the revolving development station 20 will be described referring to FIGS. 1 and 6. As compared to the developing device 23 illustrated in FIG. 1, the revolving development station 20 is configured such that four developing devices 23Bk, 23Y, 23C, 23M, are arranged about a rotation center shaft 24 in a radial direction.

In the revolving development station 20, each of the developing devices 23Bk, 23Y, 23C, 23M is configured to be removed from the multi-color development section 21. Under the condition that the multi-color development section 21 is pulled out from the main body of the multi-color image forming apparatus, each of the developing devices 23Bk, 23Y, 23C, 23M is taken out of the multi-color development section 21 for maintenance.

The developing devices 23Bk, 23Y, 23C, 23M contain black, yellow, cyan, and magenta toner, respectively. By rotating the rotation center shaft 24 in the counterclockwise direction, the developing devices 23Bk, 23Y, 23C, 23M sequentially face the latent image carrier 8 at the development position.

Referring to FIG. 7, a description will be made further of a configuration of the revolving development station 20. The revolving development station 20 includes a toner end sensor 33(Bk, Y, C, M) that detects a condition in which the amount of the toner in a toner bottle 39(Bk, Y, C, M) is low, the toner bottle 39(Bk, Y, C, M) installed above the toner supplying screw 16 to supply fresh toner to the developing device 23(Bk, Y, C, M), a toner bottle set sensor 36(Bk, Y, C, M) that detects the installation of the toner bottle 39(Bk, Y, C, M), and a home position sensor 37 that detects a home position of the revolving development station 20. Although not shown in FIG. 1, the developing device 23 can also include the toner end sensor 33, the toner bottle 39, and the toner bottle set sensor 36.

FIG. 7 is a schematic cross-sectional side view of the multi-color image forming apparatus in which the multi-color development section 21 illustrated in FIG. 6 is attached to the main body of the multi-color image forming apparatus.

Referring to FIG. 7, a scanner 54 is provided at an uppermost part of the multi-color image forming apparatus. The scanner 54 includes a contact glass 54*a* on which an original document is set and covered by a platen, a first moving carriage 54*b* and second moving carriage 54*c* provided below the contact glass 54*a*, an imaging lens 54*d*, and a charge-coupled device (CCD) 54*e* that electrically records a read image. The image information recorded in the CCD 54*e* is transmitted to a laser light source control device (not shown) of a laser writing unit 42 (described below).

The latent image carrier 8 is rotated in a direction indicated by the arrow on the latent image carrier 8 at the time of an image forming operation. Arranged around the latent image carrier 8 are a charger 40, a laser writing unit 42, the revolving development station 20, an intermediate transfer belt 43, and a latent image carrier cleaning device 44.

The laser writing unit 42 includes a laser light source (not shown), a laser light source control device (not shown) that controls the laser light source according to the image information, a polygon mirror 42*a*, a first fθ lens 42*b*, a second fθ lens 42*c*, a BTL lens 42*d*, a writing mirror 42*e*, and a dustproof glass 42*f*. A laser light is emitted from the laser light source toward the latent image carrier 8 via the above-described elements of the laser writing unit 42. The surface of the latent image carrier 8 is exposed to the laser light.

The intermediate transfer belt 43 is arranged opposite to the latent image carrier 8 such that the intermediate transfer belt 43 is brought into contact with and separated from the latent image carrier 8. Further, the intermediate transfer belt 43 is spanned around a plurality of support rollers and is driven to rotate at substantially the same speed as the latent image carrier 8 and in the trailing direction with respect to the latent image carrier 8. A bias roller 45 is configured to apply a transfer bias voltage to the intermediate transfer belt 43 to transfer a toner image formed on the latent image carrier 8 onto the intermediate transfer belt 43.

A belt cleaning unit 53 is provided such that the belt cleaning unit 53 is brought into contact with and separated from the intermediate transfer belt 43. The belt cleaning unit 53 removes a residual toner remaining on the intermediate transfer belt 43 after a toner image is transferred from the intermediate transfer belt 43 onto a sheet-like recording medium (hereafter referred to as a "transfer sheet").

A multi-color image is formed by a color electrophotographic method. Specifically, the surface of the latent image carrier 8 is uniformly charged by the charger 40 and is exposed to the laser light emitted from the laser light source in accordance with the image information read by the scanner 54, thereby forming a latent image representing the first color, for example, black, on the latent image carrier 8. The black latent image is visualized with a black toner by the developing device 23Bk containing the black toner, so that a black toner image is formed on the latent image carrier 8. Subsequently, the black toner image is transferred from the latent image carrier 8 onto the intermediate transfer belt 43. After the transfer process, the black toner remaining on the latent image carrier 8 is removed by the latent image carrier cleaning device 44.

Subsequently, the second color latent image, for example, a yellow latent image is formed on the latent image carrier 8 similarly as the black latent image, and the yellow latent image is visualized with a yellow toner by the developing device 23Y containing the yellow toner. As a result, a yellow toner image is formed on the latent image carrier 8. The yellow toner image is transferred onto the intermediate transfer belt 43 such that the yellow toner image is superimposed on the black toner image.

Similarly, the third color toner image, (e.g., a cyan toner image) and the fourth color toner image (e.g., a magenta toner image) are sequentially formed on the latent image carrier 8 and transferred onto the intermediate transfer belt 43, thereby forming a superimposed multi-color toner image on the intermediate transfer belt 43. The superimposed multi-color toner image is transferred onto a transfer sheet.

When each of the color toner images on the latent image carrier 8 is transferred onto the intermediate transfer belt 43, the intermediate transfer belt 43 is brought into contact with the latent image carrier 8. The transfer bias voltage is applied to the intermediate transfer belt 43 from the transfer bias roller 45, and thereby the color toner image on the latent image carrier 8 is transferred onto the intermediate transfer belt 43.

The color toner image transferred onto the intermediate transfer belt 43 is transferred onto a transfer sheet fed by a pair of registration rollers 48 at a secondary transfer part where a support roller 46 supporting the intermediate transfer belt 43 faces a secondary transfer roller 47 via the intermediate transfer belt 43.

The transfer sheets are accommodated in a sheet feeding cassette 49 and are fed out from the sheet feeding cassette 49 one by one toward the registration rollers 48 via an intermediate roller 52 at an appropriate timing in accordance with an image forming sequence. Alternatively, a transfer sheet is fed out from a manual sheet feeding tray 19 on which the transfer sheets are set, toward the registration rollers 48.

The transfer sheet having the color toner image is conveyed to a fixing device 51 by a sheet conveying belt 50. The color toner image is fixed onto the transfer sheet by heat and pressure while the transfer sheet passes through a nip part between a fixing roller 51*a* and a pressure roller 51*b* in the fixing device 51. After the fixing process, the transfer sheet is discharged onto a sheet discharging tray (not shown).

In a multi-color image forming apparatus, if a developer including color toner and magnetic carrier is not sufficiently charged and mixed, inferior images, such as a dirty background image and a color image having an uneven density, can be formed. However, by use of the above-described developing devices 23Bk, 23Y, 23C, 23M in the multi-color image forming apparatus, a stable and high image quality can be obtained.

Next, a description will be made of a single-color image forming apparatus to which the developing device is applied as a single device.

Figure 8:
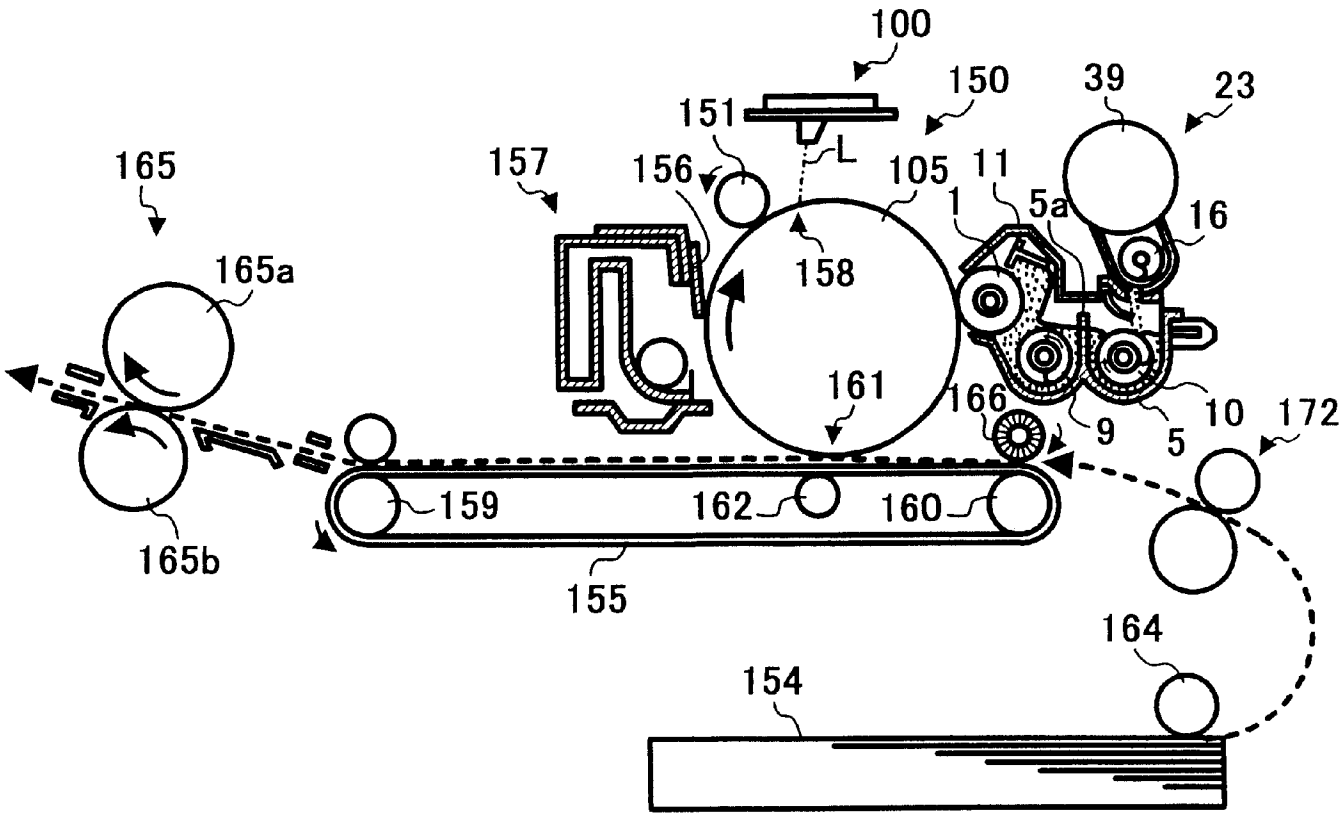
FIG. 8 is a schematic cross-sectional view of a construction of a main part of a single-color image forming apparatus including the developing device of FIG. 1.

FIG. 8 is a schematic cross-sectional side view of a construction of a single-color image forming apparatus. In the single-color image forming apparatus, arranged around a latent image carrier 150 in order in the direction of rotation of the latent image carrier 150, are a charging device 151 including a charging roller, an optical scanning device 100 serving as a laser light writing device, the developing device 23, a transfer/conveyance belt 155 that holds and conveys a transfer sheet, and a cleaning device 157 including a cleaning blade 156 in sliding contact with a peripheral surface 105 of the latent image carrier 150. The latent image carrier 150 is driven to rotate in a clockwise direction indicated by the arrow on the latent image carrier 150.

A laser beam L is emitted from the optical scanning device 100 toward a position on the latent image carrier 150 between the charging device 151 and the developer carrier 1 to scan the peripheral surface 105 of the latent image carrier 150 in an axial direction (i.e., a main scanning direction). The position on the latent image carrier 150 exposed to the laser beam L is referred to as an exposure portion 158.

The transfer/conveyance belt 155 is in a shape of an endless belt and is spanned around two support rollers 159 and 160. The part of the transfer/conveyance belt 155 between the two support rollers 159 and 160 in contact with the lower peripheral surface 105 of the latent image carrier 150 is referred to as a transfer part 161. At the transfer part 161, a transfer roller 162 is provided in contact with the rear surface of the transfer/conveyance belt 155 so as to apply a transfer bias voltage to the transfer/conveyance belt 155.

The transfer/conveyance belt 155 is driven to rotate in a counter-clockwise direction indicated by the arrow in FIG. 8. At an upstream side of the upper side portion of the transfer/conveyance belt 155 in a sheet conveying direction, a pair of registration rollers 172 are provided. Transfer sheets are accommodated in a sheet feeding cassette 154. A transfer sheet is fed out from the sheet feeding cassette 154 by a sheet feeding roller 164 and is directed to the registration rollers 172 through a sheet guide member (not shown). At a downstream side of the upper side portion of the transfer/conveyance belt 155 in a sheet conveying direction, a fixing device 165 including a fixing roller 165*a* and a pressure roller 165*b* is provided.

Above the support roller 160 which supports the transfer/conveyance belt 155 at an upstream end part of the upper side portion of the transfer/conveyance belt 155 in a sheet conveying direction, a brush roller 166 is provided in contact with the transfer/conveyance belt 155 such that the brush roller 166 is driven to rotate in a clockwise direction indicated by the arrow in FIG. 8.

When rotating the brush roller 166, the brush of the brush roller 166 is in sliding contact with the transfer/conveyance belt 155. A bias applying device (not shown) applies a bias electric current having a polarity which causes the transfer sheet to attach to the transfer/conveyance belt 155, to the brush roller 166.

In the above-described single-color image forming apparatus, an image forming operation is performed in the following manner. After the start of rotation of the latent image carrier 150, the charging device 151 charges the peripheral surface 105 of the latent image carrier 150 uniformly while the latent image carrier 150 rotates. The exposure portion 158 of the latent image carrier 150 is exposed to the laser beam L, so that a latent image corresponding to image information is formed on the latent image carrier 150. The latent image on the latent image carrier 150 is moved to a development position opposite to the developing device 23 by the rotation of the latent image carrier 150, and is visualized with toner by the developing device 23. As a result, a toner image is formed on the latent image carrier 150. The fresh toner is replenished to the second developer conveying screw 10 from the toner bottle 39.

When the above-described image forming operation starts, a transfer sheet is fed from the sheet feeding cassette 154 by the sheet feeding roller 164, conveyed through a sheet conveying path indicated by broken lines in FIG. 8, and is in a standby condition at a nip part formed between the pair of registration rollers 172. When a leading edge of a toner image on the latent image carrier 150 is about to enter the transfer part 161, the registration rollers 172 are driven so that the leading edge of the transfer sheet coincides with the leading edge of the toner image. Thereby, the registration of the transfer sheet and the toner image is performed.

The transfer sheet fed from the registration rollers 172 is sandwiched or pressed between the transfer/conveyance belt 155 and the brush roller 166, and is attached to the transfer/conveyance belt 155 by an electrostatic force due to the bias and by a pressing force due to the resilient force of the brush roller 166. The transfer sheet is further conveyed to the transfer part 161 by the movement of the transfer/conveyance belt 155.

The leading edge of the transfer sheet coincides with the leading edge of the toner image on the latent image carrier 150 at the transfer part 161, and the toner image is transferred onto the transfer sheet by an electric field formed by a potential difference between a bias applied to the transfer/conveyance belt 155 by the transfer roller 162 and the potential of the latent image carrier 150.

Subsequently, the transfer sheet having the toner image is conveyed by the transfer/conveyance belt 155 toward the fixing device 165 and is away from the transfer/conveyance belt 155 at the downstream side end portion of the upper side portion of the transfer/conveyance belt 155 in the sheet conveying direction. The toner image is fixed onto the transfer sheet while the transfer sheet passes through a nip part formed between the fixing roller 165*a* and the pressure roller 165*b*. Thereafter, the transfer sheet having the fixed toner image is discharged onto a sheet discharging section (not shown).

The residual toner remaining on the latent image carrier 150 which is not transferred onto the transfer sheet at the transfer part 161 is moved to the cleaning device 157 by the rotation of the latent image carrier 150, and is removed by the cleaning device 157 in preparation for a next image forming operation.

In a single-color image forming apparatus, if a developer including toner and magnetic carrier is not sufficiently charged and mixed, inferior images, such as a dirty background image and an image having an uneven density, can be formed. However, by use of the above-described developing device 23 in the single-color image forming apparatus, a stable and high image quality can be obtained.

The present invention has been described with respect to the embodiments as illustrated in figures. However, the present invention is not limited to the embodiments and may be practiced otherwise.

Referring to FIG. 7, a copying machine is illustrated as an example of a multi-color image forming apparatus. However, the present invention may be applied to other image forming apparatuses such as a printer and/or a facsimile machine.

Further, in the above-described multi-color image forming apparatus, the order of forming images of respective colors and/or the arrangement of the developing devices for respective colors are not limited to the ones described above and can be practiced otherwise.

Moreover, the present invention is applied to a multi-color image forming apparatus employing a revolving development station including a plurality of developing devices containing toner of respective colors. Alternatively, the present invention may be applied to a tandem type color image forming apparatus including a plurality of latent image carriers and developing devices for forming images of respective colors.

Numerous additional modifications and variations of the present invention are possible in light of the above teachings. It is therefore to be understood that within the scope of the appended claims, the present invention may be practiced otherwise than as specifically described herein.

What is claimed:

1. A developing device that develops a latent image carried on a latent image carrier with a two-component developer, the developing device comprising:

a developer carrier adapted to carry the two-component developer while rotating;

a first developer conveying screw adapted to convey the developer from a first end of the first developer conveying screw to a second end of the first developer conveying screw and to transfer the developer to the developer carrier, the first developer conveying screw being arranged about parallel to a rotation center axis of the developer carrier; and a second developer conveying screw adapted to convey the developer from a first end of the second developer conveying screw to a second end of the second developer conveying screw and to convey the developer from the second end of the second developer conveying screw to the first end of the first developer conveying screw, the second developer conveying screw being arranged about parallel to the first developer conveying screw, wherein a following relationship is satisfied:

$$T2 \geqq 3T1,$$

where T1 is a time for conveying the developer from the first to the second end of the second developer conveying screw, and T2 is a time for conveying the developer from the first to the second end of the first developer conveying screw.

2. The developing device according to claim 1, wherein the first developer conveying screw includes a plurality of spirals and the second developer conveying screw includes a single spiral, and wherein the plurality of spirals of the first developer conveying screw and the single spiral of the second developer conveying screw have spiral diameters that are about equal, diameters of the first and second developer conveying screws are about equal, and the first and second developer conveying screws are driven to rotate at about a same rotation speed.

3. The developing device according to claim 1, wherein a developer supplying position is located at an upstream side part of the second developer conveying screw in the developer conveying direction of the second developer conveying screw.

4. The developing device according to claim 1, further comprising:

a developer regulating member adapted to regulate a layer thickness of the developer carried by the developer carrier, and wherein the developer carrier includes stationary magnets having first through fifth magnetic poles and is interposed between the first developer conveying screw and the latent image carrier to transfer the developer from the first developer conveying screw onto the latent image carrier to develop the latent image carried by the latent image carrier with the developer.

5. The developing device according to claim 4, further comprising:

a developer holding section formed by the developer regulating member to hold the developer, wherein the developer carrier includes a development sleeve configured to rotate around the stationary magnets, and wherein when the stationary magnets are seen from a rotation axial direction of the developer carrier, a first magnetic pole is located at about a three o'clock position and opposite to the latent image carrier, a second magnetic pole is located from between about four to about five o'clock positions, a third magnetic pole is located from between about seven to about eight o'clock positions and opposite to the first developer conveying screw, a fourth magnetic pole is located from between about ten to about eleven o'clock positions and opposite to the developer holding section, and a fifth magnetic pole is located at about a twelve o'clock position, and wherein the development sleeve rotates and passes the magnetic poles in an order of the first, second, third, fourth, and fifth magnetic poles.

6. An image forming apparatus, comprising:

a latent image carrier adapted to carry a latent image; and at least one developing device adapted to develop the latent image with a two-component developer so as to visualize the latent image, the at least one developing device comprising:

a developer carrier adapted to carry the two-component developer while rotating;

a first developer conveying screw adapted to convey the developer from a first end of the first developer conveying screw to a second end of the first developer conveying screw and to transfer the developer to the developer carrier, the first developer conveying screw being arranged about parallel to a rotation center axis of the developer carrier; and a second developer conveying screw adapted to convey the developer from a first end of the second developer conveying screw to a second end of the second developer conveying screw and to convey the developer from the second end of the second developer conveying screw to the first end of the first developer conveying screw, the second developer conveying screw being arranged about parallel to the first developer conveying screw, wherein a following relationship is satisfied:

$$T2 \geqq 3T1,$$

where T1 is a time for conveying the developer from the first to the second end of the second developer conveying screw, and T2 is a time for conveying the developer from the first to the second end of the first developer conveying screw.

7. The image forming apparatus according to claim 6, wherein the first developer conveying screw includes a plurality of spirals and the second developer conveying screw includes a single spiral, and wherein the plurality of spirals of the first developer conveying screw and the single spiral of the second developer conveying screw have spiral diameters that are about equal, diameters of the first and second developer conveying screws are about equal, and the first and second developer conveying screws are driven to rotate at about a same rotation speed.

8. The image forming apparatus according to claim 6, wherein a developer supplying position is located at an upstream side part of the second developer conveying screw in the developer conveying direction of the second developer conveying screw.

9. The image forming apparatus according to claim 6, wherein the at least one developing device further comprises a developer regulating member adapted to regulate a layer thickness of the developer carried by the developer carrier, and wherein the developer carrier includes stationary magnets having first through fifth magnetic poles and is interposed between the first developer conveying screw and the latent image carrier to transfer the developer from the first developer conveying screw onto the latent image carrier to develop the latent image carried by the latent image carrier with the developer.

10. The image forming apparatus according to claim 9, wherein the at least one developing device further comprises a developer holding section formed by the developer regulating member to hold the developer, and wherein the developer carrier includes a development sleeve configured to rotate around the stationary magnets, and wherein when the stationary magnets are seen from a rotation axial direction of the developer carrier, a first magnetic pole is located at about a three o'clock position and opposite to the latent image carrier, a second magnetic pole is located from between about four to about five o'clock positions, a third magnetic pole is located from between about seven to about eight o'clock positions and opposite to the first developer conveying screw, a fourth magnetic pole is located from between about ten to about eleven o'clock positions and opposite to the developer holding section, and a fifth magnetic pole is located at about a twelve o'clock position, and wherein the development sleeve rotates and passes the magnetic poles in an order of the first, second, third, fourth, and fifth magnetic poles.

11. The image forming apparatus according to claim 6, wherein the at least one developing device comprises a plurality of developing devices configured to develop latent images carried on the latent image carrier with the two-component developer to each form visual images of different colors.

12. A developing device that develops a latent image carried on a latent image carrier with a two-component developer, the developing device comprising:

developer carrying means for carrying the two-component developer while rotating;

first developer conveying means for conveying the developer from a first end of the first developer conveying means to a second end of the first developer conveying means and for transferring the developer to the developer carrying means, the first developer conveying means being arranged about parallel to a rotation center axis of the developer carrying means; and second developer conveying means for conveying the developer from a first end of the second developer conveying means to a second end of the second developer conveying means and for conveying the developer from the second end of the second developer conveying means to the first end of the first developer conveying means, the second developer conveying means being arranged about parallel to the first developer conveying means, wherein a following relationship is satisfied:

$$T2 \geqq 3T1,$$

where T1 is a time for conveying the developer from the first to the second end of the second developer conveying means, and T2 is a time for conveying the developer from the first to the second end of the first developer conveying means.

13. The developing device according to claim 12, wherein the first developer conveying means includes a plurality of spirals and the second developer conveying means includes a single spiral, and wherein the plurality of spirals of the first developer conveying means and the single spiral of the second developer conveying means have spiral diameters that are about equal, diameters of the first and second developer conveying means are about equal, and the first and second developer conveying means are driven to rotate at about a same rotation speed.

14. The developing device according to claim 12, wherein a developer supplying position is located at an upstream side part of the second developer conveying means in the developer conveying direction of the second developer conveying means.

15. The developing device according to claim 12, further comprising:

regulating means for regulating a layer thickness of the developer carried by the developer carrying means, and wherein the developer carrying means includes stationary magnets having first through fifth magnetic poles and is interposed between the first developer conveying means and the latent image carrier so as to transfer the developer from the first developer conveying means onto the latent image carrier to develop the latent image carried by the latent image carrier with the developer.

16. The developing device according to claim 15, further comprising:

a developer holding section formed by the regulating means to hold the developer, wherein the developer carrying means includes a development sleeve configured to rotate around the stationary magnets, and wherein when the stationary magnets are seen from a rotation axial direction of the developer carrying means, a first magnetic pole is located at about a three o'clock position and opposite to the latent image carrier, a second magnetic pole is located from between about four to about five o'clock positions, a third magnetic pole is located from between about seven to about eight o'clock positions and opposite to the first developer conveying means, a fourth magnetic pole is located from between about ten to about eleven o'clock positions and opposite to the developer holding section, and a fifth magnetic pole is located at about a twelve o'clock position, and wherein the development sleeve rotates and passes the magnetic poles in an order of the first, second, third, fourth, and fifth magnetic poles.

17. An image forming apparatus, comprising:

latent image carrying means for carrying a latent image; and developing means for developing the latent image with a two-component developer to visualize the latent image, the developing means comprising:

developer carrying means for carrying the two-component developer while rotating;

first developer conveying means for conveying the developer from a first end of the first developer conveying means to a second end of the first developer conveying means and for transferring the developer to the developer carrying means, the first developer conveying means being arranged about parallel to a rotation center axis of the developer carrying means; and second developer conveying means for conveying the developer from a first end of the second developer conveying means to a second end of the second developer conveying means and for conveying the developer from the second end of the second developer conveying means to the first end of the first developer conveying means, the second developer conveying means being arranged about parallel to the first developer conveying means, wherein a following relationship is satisfied:

$$T2 \geqq 3T1,$$

where T1 is a time for conveying the developer from the first to the second end of the second developer conveying means, and T2 is a time for conveying the developer from the first to the second end of the first developer conveying means.

18. The image forming apparatus according to claim 17, wherein the developing means develops latent images with the two-component developer to form visual images of different colors.

19. A method of developing a latent image carried on a latent image carrier with a two-component developer, the method comprising:

carrying the developer with a rotating developer carrier;

conveying the developer from a first to a second end of a first developer conveying screw arranged about parallel to a rotation center axis of the developer carrier;

transferring the developer from the second end of the first developer conveying screw to the developer carrier with the first developer conveying screw;

conveying the developer from a first to a second end of a second developer conveying screw arranged about parallel with the first developer conveying screw; and conveying the developer from the second end of the second developer conveying screw to the first end of the first developer conveying screw with the second developer conveying screw, wherein a following relationship is satisfied:

$$T2 \geqq 3T1,$$

where T1 is a time for conveying the developer from the first to the second end of the second developer conveying screw, and T2 is a time for conveying the developer from the first to the second end of the first developer conveying screw.

20. The method according to claim 19, further comprising:

developing latent images with the developer to form visual images having different colors.

* * * * *